United States Patent [19]

Cavanaugh et al.

[11] Patent Number: 4,791,946

[45] Date of Patent: Dec. 20, 1988

[54] ALTERNATING SELECTABLE CLEANING FLUID TO AIR PURGING SYSTEM

[75] Inventors: James E. Cavanaugh; Robert D. Hetherington, both of Sunland, Calif.

[73] Assignee: Binks Manufacturing Company, Franklin Park, Ill.

[21] Appl. No.: 73,986

[22] Filed: Jul. 16, 1987

[51] Int. Cl.[4] ..... B08B 3/10

[52] U.S. Cl. ..... 134/99; 134/102; 134/105; 134/166 C; 137/595; 239/106; 239/112; 118/302

[58] Field of Search ..... 134/99, 102, 104, 105, 134/166 C, 169 C, 200, 201; 239/106, 112; 251/344; 137/595; 138/113, 114; 118/302

[56] References Cited

U.S. PATENT DOCUMENTS

| | | | |
|---|---|---|---|
| 3,146,950 | 9/1964 | Lancaster | 239/112 X |
| 3,403,695 | 10/1968 | Hopkins | 239/112 X |
| 3,674,205 | 7/1972 | Kock | 239/112 X |
| 3,716,191 | 2/1973 | Knight | 239/112 X |
| 3,790,030 | 2/1974 | Ives | 239/112 X |
| 3,876,114 | 4/1975 | Hicks et al. | 239/112 X |
| 4,534,802 | 8/1985 | Gates et al. | 239/112 X |
| 4,667,084 | 5/1987 | Regge | 138/114 X |

*Primary Examiner*—Timothy F. Simone
*Assistant Examiner*—Frankie L. Stinson
*Attorney, Agent, or Firm*—David O'Reilly

[57] ABSTRACT

A system for purging fluid delivery systems such as paint spray guns with non-toxic, non-polluting cleaning solvents. A sealed tank is provided for storing a cleaning solvent with air pressure applied to deliver the cleaning solvent through a coaxial hose to a slide selectable valve. Pressurized air is also connected to one of the conduits of the coaxial hose. Spray guns or fluid delivery systems are cleaned and purged by first releasing the cleaning solvent in the passageways and then quickly switching to a blow-down mode on the slide selectable valve to discharge the cleaning solvent from the spray gun passages.

8 Claims, 3 Drawing Sheets

ALTERNATING SELECTABLE CLEANING FLUID TO AIR PURGING SYSTEM

FIELD OF THE INVENTION

This invention relates to systems for purging or cleaning passageways in fluid spray or delivery systems, such as paint spray guns and the like, and more particularly relates to a system for quickly switching to or from a purging cleaning fluid to air.

BACKGROUND OF THE INVENTION

Presently fluid spray systems such as paint spray guns, guns for spraying internally mixed fluids and other types of fluid delivery spray systems employ solvents for cleaning the systems after use. The purging fluids presently used are a variety of fluids which have high vapor pressures and often are either toxic or highly flammable. Examples of such fluids are acetone, methyline chloride and ketone compounds. Of the ketone compounds, one type of compound called methylethyl ketone (MEK) is widely used as a solvent. The problem with these solvents is that they have high vapor pressure and can be pollutants. Environmental agencies are increasingly cracking down on the use of these fluids with federal, state and local agencies restricting their use and disposal. Some of the solvents, like acetone, are high volatile organic compounds (VOC). They're are extremely flammable compounds and have low flash point.

Generally these compounds are used to purge paint or organic compounds from spray guns or systems. The solvent is forced through the internal mixing chambers of the gun immediately after use to discharge any paint or organic compounds which could solidify and clog the gun. These solvents are generally applied to the gun under pressure, and their high vapor pressure makes them undesirable toxic pollutants. There is a trend to get away from the problems of these toxic chemicals because of increasing restrictions by regulatory agencies.

It is, therefore, one object of the present invention to provide a purging system for fluid delivery systems which avoids the use of volatile organic compounds which have high vapor pressures or are highly flammable.

Yet another object of the present invention is to provide a purging system for fluid spray or delivery systems which uses solvents that can easily be disposed of after use without any danger of pollution.

Yet another object of the present invention is to provide a purging system for fluid delivery systems which uses liquids that can be simply poured into sewer after use.

Yet another object of the present invention is to provide a purging system for fluid delivery systems which can be switched from a cleaning fluid, to an air-blow down to eliminate the purging fluid after use.

Still another object of the present invention is to provide a purging system for cleaning lines and mixing chambers of fluid delivery systems which delivers an emulsifying agent under pressure which can be quickly switched to purging air.

BRIEF DESCRIPTION OF THE INVENTION

The purpose of the present invention is to provide a purging system for cleaning fluid delivery systems such as spray guns and the like which uses non-toxic fluids to avoid restrictive regulations of environmental agencies.

The system of the invention uses a pressurized storage tank containing a cleaning or purging fluid such as an emulsifier which is maintained under pressure. The tank is connected to a coaxial hose and a slide valve which allows the user to quickly switch to or from purging fluid to air, to expel the cleaning fluid from the spray system. The use of a coaxial hose and a slideable spool valve switchable from an inner conduit hose, to an outer conduit in the coaxial hose, eliminates unwieldy hoses and separate fittings which are undesirable. The selector valve has an outer sleeve or cylinder which is slid coaxially to switch from purging fluid or emulsifier, to purging air and back, easily and quickly. The selector valve will adapt to all internal mix spray devices, or spray systems.

The pressurized tank has a lid sealed with clamping nuts. An air pressure regulator mounted on the cover or lid delivers air under pressure to the tank. A coaxial T fitting mounted on the tank cover is connected to the coaxial hose and also to a pickup tube extending to near the bottom of the tank. The coaxial tee fitting is also connected to the air prssure regulator to deliver purging air to the outer conduit of the coaxial tube.

To purge or clean a spraying system or gun the selector valve is connected to the fluid delivery system, spray gun inlet, or the like, and air pressure applied to the purging fluid storage tank. Fluid is forced out through the pickup tube into the center conduit of the coaxial tube to quickly purge paint or organic compounds in the internal passages and mixing chamber of the fluid delivery system. A wide range of cleaning fluids or emulsifiers may be used in the system depending upon the fluid delivery system being cleaned. After a few seconds of forcing an emulsifying agent under pressure through the fluid delivery system, the selector valve is activated to connect high pressure purging air flow down to the system being cleaned. The purging air forces all the cleaning fluid from the passages in the spray gun or fluid delivery system.

The pickup tube in the storage tank has a small aperture for bleeding air into the pickup tube as the cleaning fluid is delivered to the system being cleaned. The small amount of bleed air assists in creating a foaming action of the cleaning fluid to increase the scrubbing effect of the cleaning fluid as it flows through the passageway of the spray gun or fluid delivery system.

The above and other novel features and advantages of this invention will be more fully understood from the following detailed description and the accompanying drawings, in which:

DETAILED DESCRIPTION OF THE INVENTION

Figure 1:
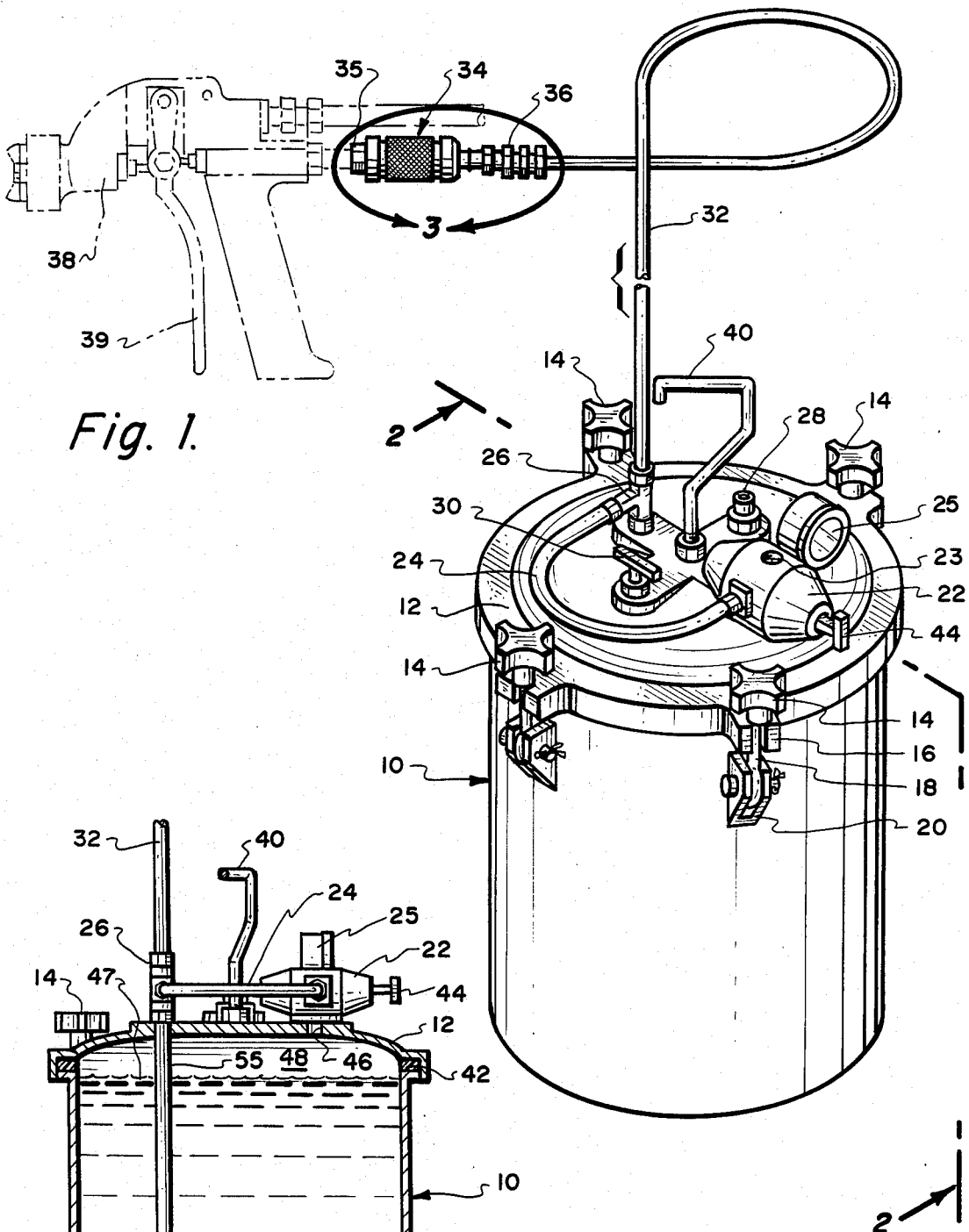
FIG. 1 is a illustration of a switchable purging system according to the invention.

An alternately switchable fluid to air purging system is illustrated generally in FIG. 1. The system is comprised of storage tank 10 having cover 12 which can be tightly sealed by star nuts 14 engaging slots on the cap 16 clamping gasket 42 tightly down on the tank rim. The nuts 14 are mounted on eyebolts 18, pivotally mounted in lugs 20 secured to tank 10. The tank is tightly sealed to allow substantial pressure to be applied to fluid within the tank.

Air pressure is applied to air regulator 22 through an air hose (not shown) connected to threaded port 23. Storage tank pressure is shown by gauge 25. Regulated air is also applied through hose 24 to coaxial tee fitting 26, as will be described in greater detail hereinafter. Storage tank 10 is also provided with a 100 psi pressure relieve safety valve 28 and a bleed valve 30 for releasing pressure from the tank.

Coaxial tee 26 connects coaxial hose 32 to tank cover 12 and is connected at the other end to slide selectable valve 34 having a fitting 35 for connecting to spray gun 38 or a fluid delivery system to which the purging fluid is being delivered. Handle 40 on storage tank cover 12 allows the tank to be easily transported from site to site for cleaning or purging spray guns or spray delivery systems.

Figure 2:
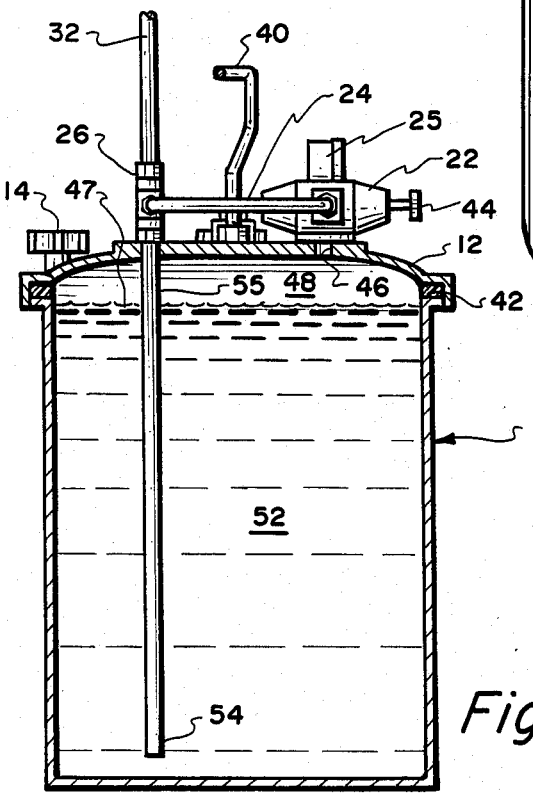
FIG. 2 is a sectional view taken at 2—2 of FIG. 1.

The sectional view of FIG. 2 illustrates a seal 42 beneath cover 12 securely clamped by star nuts 14 equally spaced around cover 12. Regulated air pressure is applied by adjusting handle 44 on air pressure regulator 22 to deliver air through inlet 46 to cavity 48 above fluid level 47 in tank 10. Pressure in cavity 48 forces fluid 52 in tank 10 up through pickup tube 54 for delivery through tee 26 to the center conduit of coaxial hose 32.

A unique slide selectable valve is shown in greater detail in FIGS. 3 through 6. Slide selectable valve 34 is a spool type valve for flow selection which can be attached to the end of any coaxial hose. The flow selector of the selector valve permits coaxial hose 32 to be connected to spray gun 38, or other fluid delivery device, and allows quick alternating selection from purging fluid to purging air and back.

Figure 3:
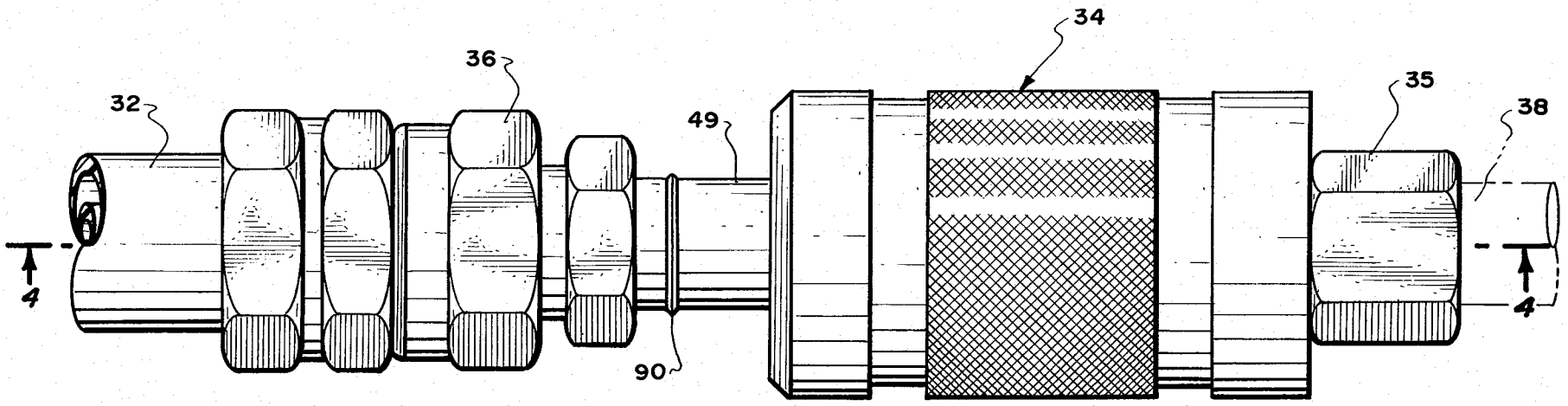
FIG. 3 is an enlarged view of a slide selectable valve.

In FIG. 3 coaxial hose 32 is connected by a fitting 36 to flow slide selecting valve 34. Selector valve 34 is comprised of tubes 49 and 51 and a sliding sleeve 50 slideable to two or more positions on tubes 49 and 51. Wall 52 closes outlet passage 53 from direct flow through tubes 49 and 51. The position of slideable sleeve 50 selects flow from center conduit 56 or outer conduit 58 in tube 49 to outlet passage 53.

Figure 4:
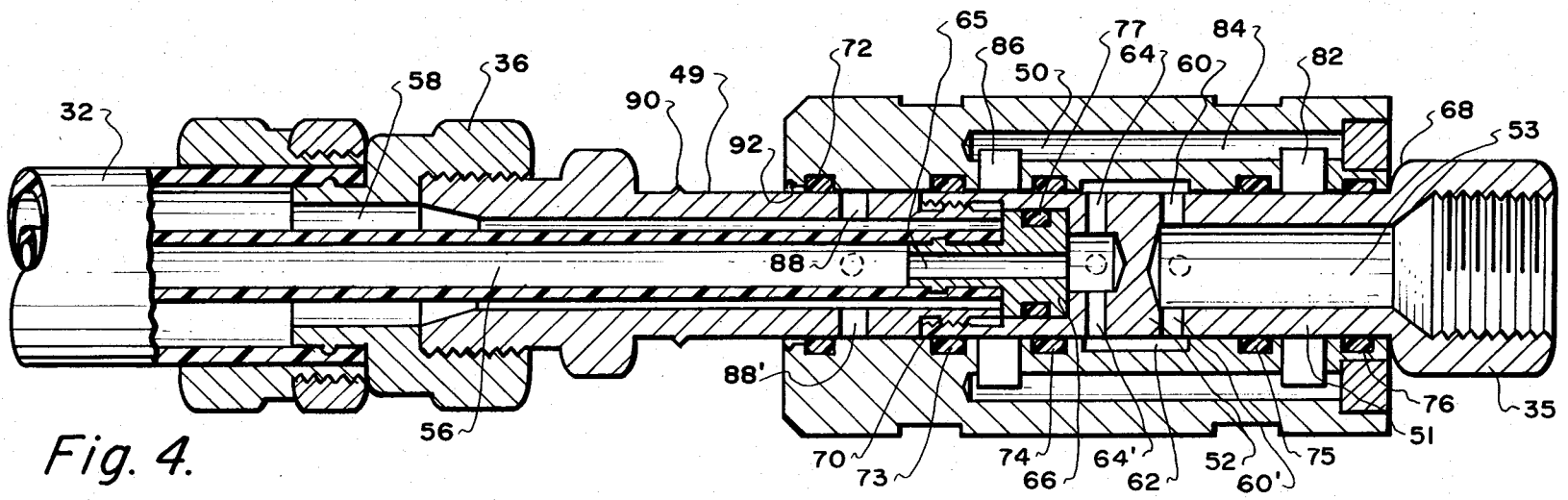
FIG. 4 is a sectional view of the slide selectable valve in a position for delivering fluid through the center conduit of the coaxial hose.
Figure 5:
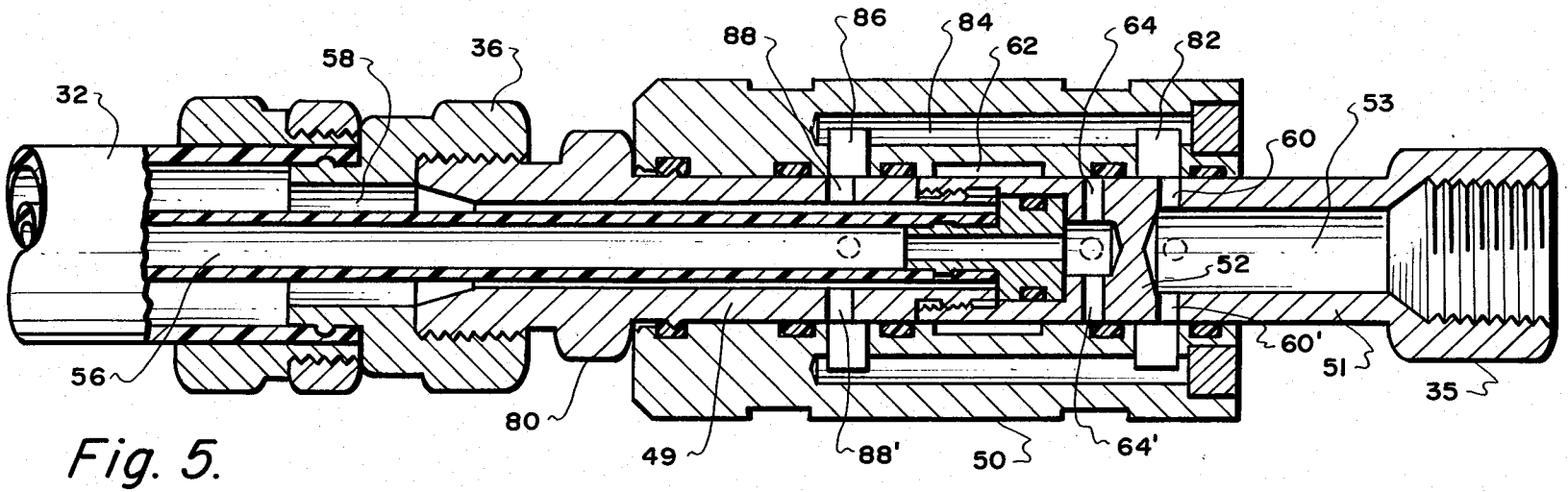
FIG. 5 is a sectional view similar to FIG. 4 showing the selector valve in a forward position for delivering air through the outer conduit of a coaxial hose system.

With slideable sleeve 50 in the position shown in FIG. 4 outlet passageway 53 is connected through ports 60 and 60' and annulus 62 in sleeve 50 to ports 64 and 64' communicating through passageway 65 in internal coaxial hose fitting 66 which is clamped between tubes 49 and 51. Slidable sleeve 50 connects center conduit 56 to outlet 53 when fully formed against shoulder 68 properly aligning ports and passageways.

Slideable sleeve 50 is installed by separating tubes 49 and 51 at threads 70. O-rings 72 through 76 seal the sleeve on tubes 49 and 51 while o-ring 76 provides an internal seal.

To connect outlet passageway 53 to flow from outer conduit 58 sleeve 50 is slid back to abut against shoulder 80 with ports 60 and 60' connected through passageways 82, 82', 84, 84' and 86, 86' to ports 88 and 88' in wall of tube 49. This connects air flowing in outer conduit 58 to outlet passage.

Figure 6:
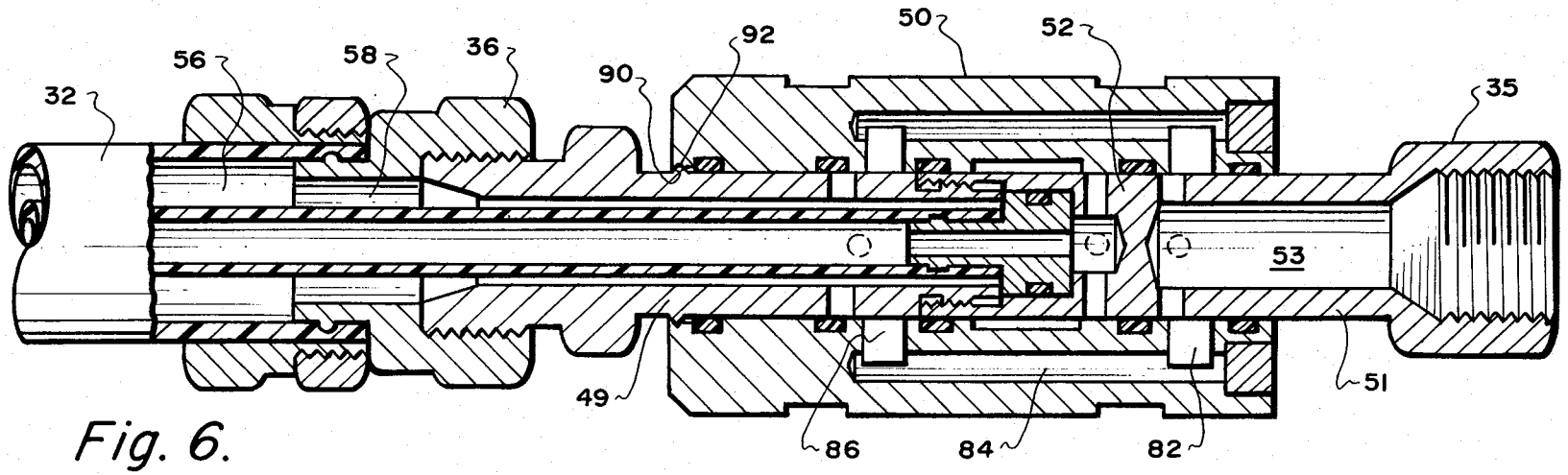
FIG. 6 illustrates the selector valve in a neutral position, preventing flow through either the inner or outer conduits of a coaxial hose system.

As an alternate, both passages can be closed by selector valve sleeve 50 being moved to an intermediate position illustrated in FIG. 6 with detent 90 engaging a locking ridge 92 on tube 49. In this position flow from either inner conduit 56 or outer conduit 58 is shut off. Flow from either conduit can be restored by simply moving sleeve 50 forward or backward to align the passageways.

In use threaded fitting 35 on tube 51 is connected to a fluid delivery system such as spray gun 38 (FIG. 1) and pressure applied through pressure regulator 22 to fluid 52 in tank 10. Fluid then flows up through dip tube 54 is agitated and foamed by air entering bleed hole 55 and is delivered through inner conduit 56 selected by slide valve 34 in the position shown in FIG. 4 to purge spray gun 38 with a cleaning solvent. Shortly after allowing an emulsifying agent or cleansing fluid to flow through gun 38 sleeve 50 on selector valve 34 is moved to a fully rearward position connecting air pressure conduit 58 to outlet passageway 53 to force high pressure air through gun 38 cleansing the cleaning fluid from the gun. In this manner spray guns or spray systems can be quickly cleaned of contaminating fluids by first forcing an emulsifying or cleansing agent through the gun and then quickly applying purging air under pressure to blow the cleansing fluid out of the gun. The system disclosed effectively eliminates the need to use highly toxic or flammable volatile organic compounds which can pollute or contaminate.

Thus, there has been described a novel and unique system for using non-toxic fluids for cleaning fluid delivery systems which can alternatively select a cleansing fluid and then a blowdown purging air. Fluid is first applied from a pressurized tank which is then discharged from the fluid delivery system by purging air.

This invention is not to be limited by the embodiment shown in the drawings and described in the description which is given by way of example and not of limitation, but only in accordance with the scope of the appended claims.

What is claimed is:

1. A purging system for cleaning passageways in fluid delivery systems such as paint spray guns, and the like, comprising:

storage tank means for storing and supplying a cleaning solvent to a fluid delivery system;

coaxial hose means connected to said storage tank means;

connecting means for connecting said coaxial hose means to said fluid delivery system to be purged;

an in-line valve means in said coaxial hose means for alternately selecting flow through said coaxial hose means from an inner conduit to an outer conduit and back;

said in-line valve means comprising;

tubular means connected in line with said coaxial hose means having coaxial inlet passageways and an outlet passageway;

sleeve means slideably mounted on said tubular means;

said sleeve means slideable on said tubular means to alternately connect said coaxial inlet passageways to said outlet passagway so that a fluid delivery system connected to said coaxial hose means may be quickly alternated between purging fluid and purging air;

delivery means for delivering said cleaning solvent to one of said conduits of said coaxial hose;

air pressure supply means connected to supply air under pressure to the other of said conduits in said coaxial hose;

whereby a fluid delivery system connected to said coaxial hose means may be alternately purged with a cleaning solvent and air under pressure.

2. The system according to claim 1 in which said slideable sleeve means has an intermediate third position blocking flow between said coaxial inlet passageways to said outlet passageway.

3. The system according to claim 1 in which said cleaning solvent is delivered by pressurizing said tank with air under pressure.

4. The system according to claim 3 including means connecting one of said conduits in said coaxial hose means to said air pressure.

5. The system according to claim 4 in which said storage tank includes; a pickup tube connected to the other of said conduits in said coaxial hose means.

6. The system according to claim 5 including a small bleed hole near an upper end of said pickup tube for injecting air under pressure into said pickup tube whereby said fluid flowing in said pickup tube is agitated by said air pressure.

7. The system according to claim 6 in which said cleaning solvent is a non-toxic, non-polluting emulsifying agent which is foamed by the air entering said pickup tube.

8. The system according to claim 3 in which said means for pressurizing includes a cover;

means for sealingly clamping said cover on said tank;

means for applying air under pressure to said tank;

whereby the air pressure forces fluid out of said tank to said coaxial base means.

* * * * *